US008220361B2

(12) United States Patent
Slavin et al.

(10) Patent No.: US 8,220,361 B2
(45) Date of Patent: Jul. 17, 2012

(54) ROTARY KNOB ASSEMBLY

(75) Inventors: Jamie L. Slavin, Deerfield Beach, FL (US); Jody H. Akens, Weston, FL (US); Scott H. Richards, Plantation, FL (US)

(73) Assignee: Motorola Solutions, Inc., Schaumburg, IL (US)

( * ) Notice: Subject to any disclaimer, the term of this patent is extended or adjusted under 35 U.S.C. 154(b) by 1038 days.

(21) Appl. No.: 11/694,772

(22) Filed: Mar. 30, 2007

(65) Prior Publication Data

US 2008/0236329 A1 Oct. 2, 2008

(51) Int. Cl.

| | |
|---|---|
| ***G05G 1/10*** | (2006.01) |
| ***G05G 1/06*** | (2006.01) |
| ***H01H 3/08*** | (2006.01) |
| ***H01H 13/70*** | (2006.01) |
| ***H01H 1/00*** | (2006.01) |

(52) U.S. Cl. ..... 74/553; 200/273; 200/336; 200/345; 16/441; 455/90.3

(58) Field of Classification Search ..... 74/553; 264/273; 403/329; 455/90.3, 575.1, 90; 16/441; 200/43.11, 527, 564, 273, 336, 345, 200/334

See application file for complete search history.

(56) References Cited

U.S. PATENT DOCUMENTS

| | | | | |
|---|---|---|---|---|
| 5,001,316 | A * | 3/1991 | Salaman | 200/527 |
| 5,345,838 | A * | 9/1994 | Howie, Jr. | 74/553 |
| 5,506,378 | A | 4/1996 | Goldenberg | |
| 5,784,688 | A | 7/1998 | Siddoway | |
| 6,355,009 | B1 * | 3/2002 | Henkin et al. | 601/155 |
| 6,448,523 | B1 * | 9/2002 | Aizawa | 200/564 |
| 6,463,630 | B1 * | 10/2002 | Howie, Jr. | 16/441 |
| 6,512,189 | B1 | 1/2003 | Schuberth et al. | |
| 6,528,001 | B1 * | 3/2003 | Howie, Jr. | 264/273 |
| 6,709,188 | B2 * | 3/2004 | Ushimaru | 403/329 |
| 7,038,148 | B2 | 5/2006 | Shirakawa | |
| D564,999 | S | 3/2008 | Richards et al. | |
| 7,495,187 | B2 * | 2/2009 | Sallam et al. | 200/11 R |
| 8,142,393 | B2 * | 3/2012 | Myers | 604/74 |
| 2004/0041086 | A1 * | 3/2004 | Imamura | 250/231.14 |
| 2007/0051606 | A1 | 3/2007 | Sallam et al. | |

FOREIGN PATENT DOCUMENTS

| | | | |
|---|---|---|---|
| JP | 2001189116 | A | 7/2001 |
| KR | 2019980026907 | U | 8/1998 |
| KR | 1020070027166 | A | 3/2007 |

OTHER PUBLICATIONS

PCT International Search Report Application No. PCT/US2008/056582 Dated August 8, 2008—11 pages. PCT/US2008/056582—International Search Report with Written Opinion dated Aug. 8, 2008—11 pages.

* cited by examiner

*Primary Examiner* — Vinh T. Luong
(74) *Attorney, Agent, or Firm* — Barbara R. Doutre

(57) ABSTRACT

A rotary knob assembly (100) includes a fixed raised boss (110) having a boss cavity (107) and a knob (102) optionally having a rotary switch stem (104) therein. The knob can include a portion that axially resides within the boss cavity such that impacts to the knob transfers to the fixed raised boss. The knob can further include a rigid core member (106) and an outer over-molded portion (108) over-molded on to the rigid core member. The fixed raised boss can include an outer circumference (118) and an inner circumference (116). The inner circumference of the boss and a portion of the rigid core member and the outer circumference of the boss and the outer mover-molded portion form a knob-boss interface (117) that sustains impacts to the rotary knob assembly while isolating a rotary switch (112) from impacts.

24 Claims, 3 Drawing Sheets

ROTARY KNOB ASSEMBLY

FIELD

This invention relates generally to rotary knobs, and more particularly to a rotary knob arrangement or assembly that is impact resistant.

BACKGROUND

Two-way handheld or mobile radio users are familiar and accustomed to rotary controls. Such controls are susceptible to damage during impact, due to inadvertent drops or mishandling. Such controls on a radio can include for example volume control, channel selection, and squelch control among others. Since products are generally decreasing in size, traditional rotary controls tend to be mounted in close proximity to other controls on a given product. Thus, damage to rotary controls is exacerbated by requirements for an appropriately or ergonomically sized control at the user interface as well as by use of miniaturized shafts used to actuate a physical switch component. Further note that the force of impact on the external surface of such rotary controls or knobs often gets transmitted to the switching element within a radio housing resulting in physical damage to the switching element and possibly other contact points within the radio.

Another issue confronting rotary controls on a control surface of a product involves inadvertent or unintentional actuation of controls. The grip area accessible by users for these rotary controls traditionally extends to the control surface of a product. This results in an increased risk of inadvertent actuation as the operation of one control might cause a user's rotating fingers to accidentally adjust an adjacent control. End users expect rotary controls to be spaced with appropriate lateral clearances to adjacent controls as embodied in previous, larger, products to suit the size of a user's hands and fingers during operation. Although various attempts have been made to reduce the effects of impacts to switching elements in radios, such attempts fail to reduce the risk of inadvertent actuation. In some instances a boss is used, but the boss protrudes into a core of the knob.

SUMMARY

Embodiments in accordance with the present invention can provide a knob arrangement that is impact resistant and ergonomically designed to avoid inadvertent activation of other adjacent control functions on a control top or control surface of an electronic product such as a mobile radio.

In a first embodiment of the present invention, a rotary knob assembly can include a fixed raised boss having a boss cavity and a knob optionally having a rotary switch stem therein. Note, the rotary switch stem can be part of the knob or part of a rotary switch. The knob can include a portion that axially resides within the boss cavity such that impacts to the knob transfers to the fixed raised boss. The knob can further include a rigid core member and an outer over-molded portion which is over-molded on to the rigid core member. The fixed raised boss can include an outer circumference and an inner circumference where at least a portion of the rigid core member resides within the inner circumference and within the boss cavity and the outer over-molded portion resides within the outer circumference but outside the boss cavity. The inner circumference of the boss and the portion of the rigid core member as well as the outer circumference of the boss and the outer mover-molded portion form a knob-boss interface that sustains impacts to the rotary knob assembly while isolating a rotary switch from impacts. The rotary knob assembly can be arranged and constructed to isolate the rotary switch stem from impacts to the knob as impacts to the knob are transferred to the fixed raised boss. In one particular embodiment the rotary switch stem is coupled to a rotary switch within an electronic product housing and the rotary knob assembly is further arranged and constructed to isolate the rotary switch stem and the rotary switch from impacts to the knob as impacts to the knob are transferred to the fixed raised boss. The fixed raised boss can be affixed to a control top of a portable electronic product and the fixed raised boss remains external to a core member of the knob. The fixed raised boss can also be affixed more particularly to a control top of a portable two-way radio.

In a second embodiment of the present invention a rotary knob assembly can include a rotary control member for controlling a switch, a fixed raised boss concentrically surrounding the rotary control member and further having a boss cavity, and a knob having a core portion coupled to the rotary control member where the core portion axially resides within the boss cavity such that impacts to the knob transfers to the fixed raised boss. The core portion can include a rigid core member and an outer over-molded portion which is over-molded on to the rigid core member. The fixed raised knob can include an outer circumference and an inner circumference where at least a portion of the rigid core member resides within the inner circumference and within the boss cavity and where the outer over-molded portion resides within the outer circumference but outside the boss cavity. The rotary knob assembly can be arranged and constructed to isolate the rotary switch stem from impacts to the knob as impacts to the knob are transferred to the fixed raised boss. A rotary switch stem can form a part of the rotary control member which is coupled to a rotary switch within an electronic product housing. The rotary knob assembly can be further arranged and constructed to isolate the rotary switch stem and the rotary switch from impacts to the knob as impacts to the knob are transferred to the fixed raised boss. The fixed raised boss can be affixed to a control top of a portable electronic product such as a portable two-way radio and the fixed raised boss can remain external to a core member of the knob. The fixed raised boss can cause the knob to be raised above other control knobs residing on the control top.

In a third embodiment of the present invention, a portable electronic product can include a control top having a plurality of controls and at least one rotary knob assembly including a rotary control member for controlling a switch, a fixed raised boss concentrically surrounding the rotary control member and further having a boss cavity, and a knob having a core portion coupled to the rotary control member where the core portion axially resides within the boss cavity such that impacts to the knob transfers to the fixed raised boss. The core portion can include a rigid core member and the knob further includes an outer over-molded portion which is over-molded on to the rigid core member. The fixed raised knob can include an outer circumference and an inner circumference where at least a portion of the rigid core member resides within the inner circumference and within the boss cavity and where the outer over-molded portion resides within the outer circumference but outside the boss cavity. The fixed raised boss can be affixed to the control top of the portable electronic product and the fixed raised boss can cause the knob to be raised above other control knobs residing on the control top.

The terms "a" or "an," as used herein, are defined as one or more than one. The term "plurality," as used herein, is defined as two or more than two. The term "another," as used herein, is defined as at least a second or more. The terms "including"

and/or "having," as used herein, are defined as comprising (i.e., open language). The term "coupled," as used herein, is defined as connected, although not necessarily directly, and not necessarily mechanically.

DETAILED DESCRIPTION OF THE DRAWINGS

Figure 1:
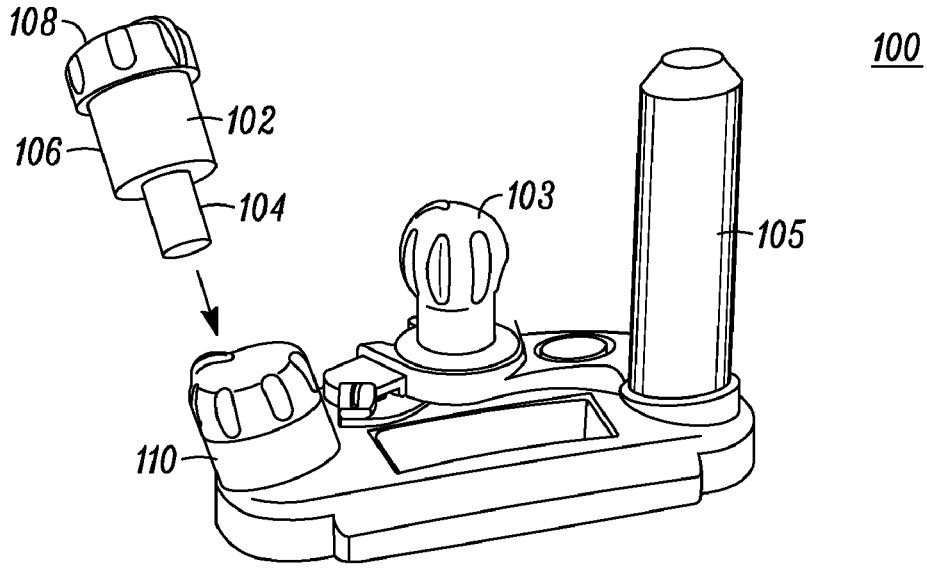
FIG. 1 is an illustration of a rotary knob assembly on a control top in accordance with an embodiment of the present invention.
Figure 2:
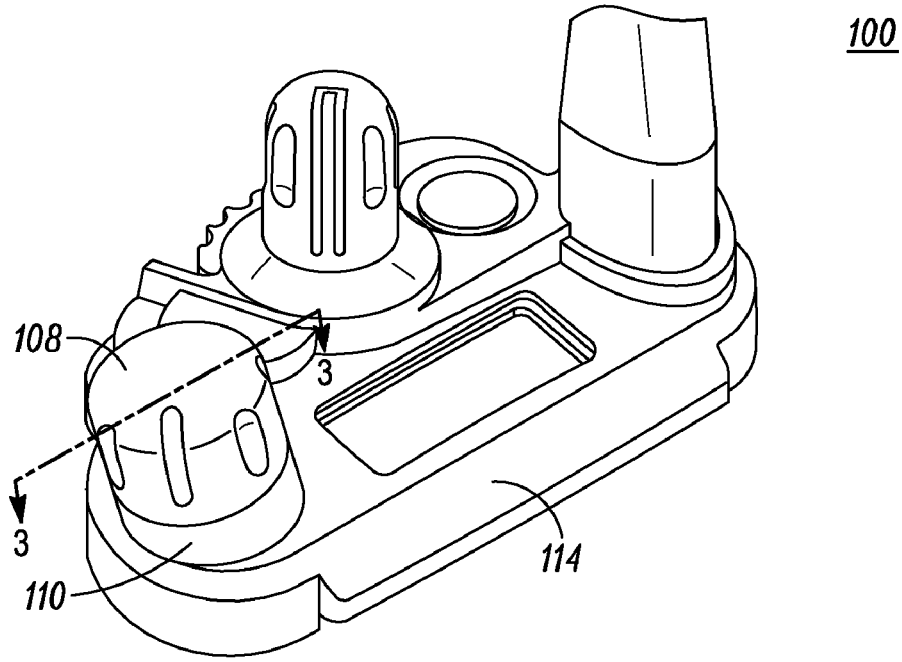
FIG. 2 is another perspective view of the rotary knob assembly of FIG. 1 in accordance with an embodiment of the present invention.

While the specification concludes with claims defining the features of embodiments of the invention that are regarded as novel, it is believed that the invention will be better understood from a consideration of the following description in conjunction with the figures, in which like reference numerals are carried forward.

Embodiments herein can be implemented in a wide variety of exemplary ways to provide a rotary knob assembly or arrangement used either individually or on a control top or surface in a manner that ergonomically allows users to avoid inadvertent or accidental adjustment of adjacent controls while provide impact resistance.

In several embodiments, a rotary knob assembly 100 as shown in FIGS. 1-4 can include a fixed raised boss 110 having a boss cavity 107 and a knob 102 having an optional rotary switch stem 104 therein. Note, the stem 104 can be part of the knob 102 and can be of varied length based on the mating with a rotary switch 112 and a mating stem for the rotary switch 112. Alternatively, the stem 104 can be solely a portion of the rotary switch 112 where the stem 104 fits within a cavity within the core member 106 of the knob 102. The knob 102 can include a portion 106 that axially resides within the boss cavity 107 such that impacts to the knob transfers to the fixed raised boss 110. The knob 102 can further include a rigid core member 106 and an outer over-molded portion 108 which is over-molded on to the rigid core member 106. The fixed raised boss 110 can include an outer circumference 118 and an inner circumference 116 where at least a portion of the rigid core member 106 resides within the inner circumference and within the boss cavity 107 and the outer over-molded portion 108 resides within the outer circumference 118 but outside the boss cavity 107. The inner circumference 116 of the boss 110 and the portion of the rigid core member 106 as well as the outer circumference 118 of the boss and the outer mover-molded portion 108 form a knob-boss interface 117 that sustains impacts to the rotary knob assembly 100 while isolating a rotary switch 112 from impacts. The rotary knob assembly 100 can be arranged and constructed to isolate the rotary switch stem 104 from impacts to the knob 108 as impacts to the knob 108 are transferred to the fixed raised boss 110. In one particular embodiment the rotary switch stem 104 is coupled to a rotary switch 112 within an electronic product housing 114 and the rotary knob assembly 100 is further arranged and constructed to isolate the rotary switch stem 104 and the rotary switch 112 from impacts to the knob 108 as impacts to the knob 108 are transferred to the fixed raised boss 110. The fixed raised boss 110 can be affixed to a control top of a portable electronic product such as a two-way radio having other controls or control knobs 103 and optionally an antenna 105 on the control top. The fixed raised boss 110 can remain external to a core member 106 of the knob assembly 102. The fixed raised boss 110 as shown can also be affixed more particularly to a control top of a portable two-way radio. Further note, the fixed raised boss 110 can cause the knob 102 to be raised above other control knobs 103 or other controls 115 (see FIG. 4) residing on the control top. This arrangement helps avoid accidental or inadvertent actuation of the other knobs or controls (103 or 115) when adjusting the knob 102 or 108.

Figure 3:
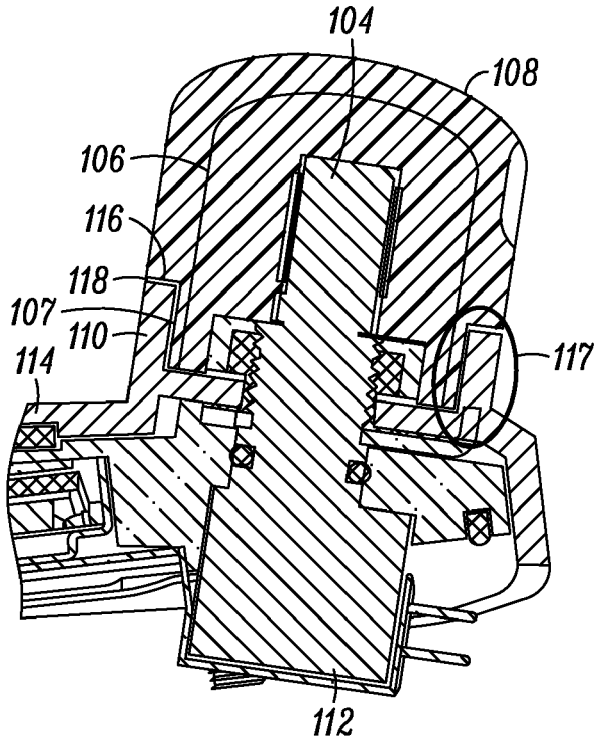
FIG. 3 is a cut view along line 3 of the rotary knob assembly of FIG. 2 in accordance with an embodiment of the present invention.
Figure 4:
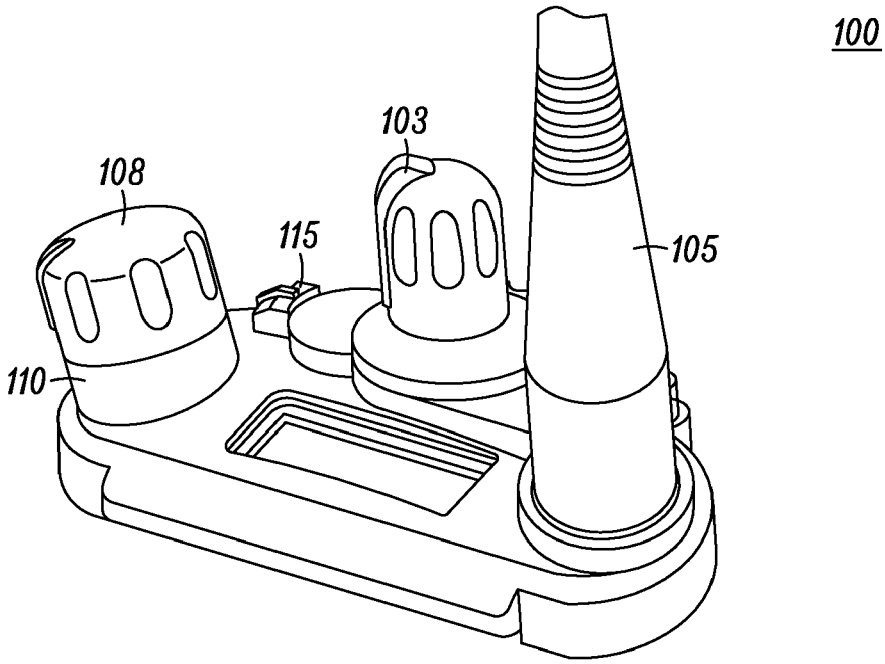
FIG. 4 is yet another perspective view of the rotary knob assembly of FIG. 1.

With reference to FIG. 3, embodiments in accordance with the invention can include a fixed boss 110 which is concentric to the rotary control stem 104 or rotary control switch 112 and which is equal or greater in diameter to the rotary control user interface or knob 108. The fixed boss 110 can also incorporate a concentrically relieved inner cavity, of a predetermined thickness to ensure sufficient rigidity of the outer wall. This cavity 107 can accept a corresponding feature of the knob 102. The rotary interface control or knob 108 can also include a gripping area that can be made of plastic or hard rubber and a concentrically corresponding protrusion which is smaller in diameter and previously referred to as the core member 106. The core member 106 can fit axially into the boss cavity 107. As noted above, the raised boss 110 and the knob-boss interface 117 are arrange so that any transverse impact (i.e., side load) is transferred from the knob 102 (106 and 108) to the boss 110. This transfer isolates the internal switch 112 from such impacts. The height of the boss 110 also provides the user with a defined active gripping zone which is elevated from the main control surface of the product and provides clearance from a user's fingertips to other possible adjacent controls on the product. This clearance allows for a greatly reduced risk of inadvertent actuation. Furthermore, the knob 102 and boss 110 as shown allows the height of the knob gripping area (108) to be increased by increasing the boss height without changing the length of the knob. Note that the knob length can remain minimal and consequently reduce the risk of impact damage to the rotary switch 112 even when a tall knob profile is desired.

The arrangements described herein shifts the impact load from a knob-switch interface to the knob-boss interface 117 and thus protecting the switch 112 from damage. Also, by adding the boss 110, the gripping area of the knob (108) is placed in a favorable location to allow for the reduction of inadvertent actuation.

Figure 5:
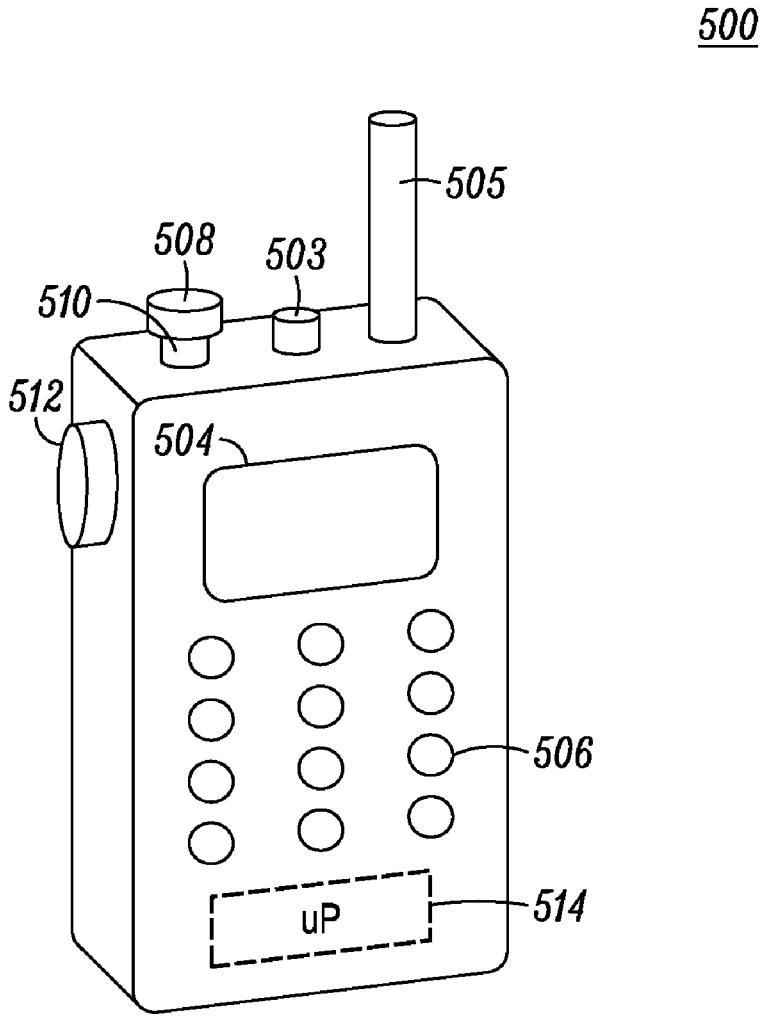
FIG. 5 is an illustration of a rotary knob assembly on a portable two-way radio in accordance with an embodiment of the present invention.

The embodiments shown thus far show a slanted rotary knob assembly, however the assembly need not be in a slanted configuration. The embodiments herein can be implemented in any product which incorporates rotary controls such as a portable electronic product. With particular reference to FIG. 5, a portable electronic product 500 such as a two-way radio can include a user interface having, for example, a display 504, a key or keypad 506 and a push-to-talk button 512. The portable electronic product 500 can be operationally controlled using a processor 514. A control top of the portable electronic product 500 can include an antenna 505 and control knobs 503 and 508. A portion of knob 508 can reside within a raised boss 510 and can be similarly arranged and constructed to the knob 102 and boss 110 of FIGS. 1-4. As seen in FIG. 5, the boss 510 can be (smaller or larger) than knob 508 as long as core member 106 transfers the load to the inside wall of the boss 110.

In light of the foregoing description, it should also be recognized that embodiments in accordance with the present invention can be realized in numerous configurations contemplated to be within the scope and spirit of the claims. Additionally, the description above is intended by way of example only and is not intended to limit the present invention in any way, except as set forth in the following claims.

What is claimed is:

1. A rotary knob assembly of a portable electronic device, comprising:

a fixed raised boss, having a boss cavity, raised from a control top surface of the portable electronic device, the control top surface comprising one or more controls for the portable electronic device; and a knob located within the fixed raised boss, the knob comprising:

a rotary switch stem coupled to a rotary switch therein;

a core member that axially resides within the boss cavity; and an outer over-molded portion which is integrally over-molded as one piece onto the core member;

wherein the fixed raised boss includes an outer circumference and an inner circumference, the fixed raised boss forming a knob-boss interface with the knob, where at least a portion of the core member resides within the inner circumference and within the boss cavity, and the outer over-molded portion resides within the outer circumference but outside the boss cavity, the rotary knob assembly transferring impacts received at the knob to the fixed raised boss through the boss-knob interface while isolating the rotary switch.

2. The rotary knob assembly of claim 1, wherein the rotary switch stem is coupled to the rotary switch, and wherein the inner circumference of the boss and the portion of the core member as well as the outer circumference of the boss and the outer over-molded portion form the knob-boss interface that sustains impacts to the rotary knob assembly while isolating the rotary switch from impacts.

3. The rotary knob assembly of claim 1, wherein the rotary knob assembly is arranged and constructed to isolate the rotary switch stem from impacts to the knob as impacts to the knob are transferred to the fixed raised boss.

4. The rotary knob assembly of claim 1, wherein the rotary switch stem is coupled to the rotary switch within a housing of the portable electronic device and the rotary knob assembly is further arranged and constructed to isolate the rotary switch stem and the rotary switch from impacts to the knob as impacts to the knob are transferred to the fixed raised boss.

5. The rotary knob assembly of claim 1, wherein the fixed raised boss remains external to the core member of the knob.

6. The rotary knob assembly of claim 1, wherein the portable electronic device is a portable two-way radio.

7. The rotary knob assembly of claim 1, wherein the fixed raised boss provides an elevated gripping zone for the knob.

8. The rotary knob assembly of claim 1, wherein knob length is independent of fixed raised boss height.

9. The rotary knob assembly of claim 1, wherein the fixed raised boss is equal or greater in diameter to the knob.

10. A rotary knob assembly of a portable electronic device, comprising:

a rotary control member for controlling a rotary switch;

a fixed raised boss, concentrically surrounding the rotary control member and further having a boss cavity, raised from a control top surface of the portable electronic device, the control top surface comprising one or more controls for the portable electronic device; and a knob located within the fixed raised boss, the knob comprising:

a core member coupled to the rotary control member, wherein the core member axially resides within the boss cavity; and an outer over-molded portion which is integrally over-molded as one piece onto the core member;

wherein the fixed raised boss includes an outer circumference and an inner circumference, the fixed raised boss forming a knob-boss interface with the knob, where at least a portion of the core member resides within the inner circumference and within the boss cavity, and the outer over-molded portion resides within the outer circumference but outside the boss cavity, wherein the rotary knob assembly transfers an impact received at the knob to the fixed raised boss through the knob-boss interface while isolating the rotary switch.

11. The rotary knob assembly of claim 10, wherein a rotary switch stem forming a part of the rotary control member is coupled to the rotary switch within a housing of the portable electronic device and the rotary knob assembly is further arranged and constructed to isolate the rotary switch stem and the rotary switch from impacts to the knob as impacts to the knob are transferred to the fixed raised boss.

12. The rotary knob assembly of claim 10, wherein the fixed raised boss remains external to the core member of the knob.

13. The rotary knob assembly of claim 10, wherein the portable electronic device is a portable two-way radio and wherein the fixed raised boss causes the knob to be raised above other control knobs residing on the control surface.

14. The rotary knob assembly of claim 13, wherein the fixed raised boss provides an elevated gripping zone for a user of the portable two-way radio.

15. The rotary knob assembly of claim 10, wherein a length of the knob is independent of a height of the fixed raised boss.

16. The rotary knob assembly of claim 10, wherein the fixed raised boss is equal or greater in diameter to the knob.

17. A portable electronic product, comprising:

a control top surface having a plurality of controls; and at least one rotary knob assembly, comprising:

a rotary control member for controlling a rotary switch;

a fixed raised boss, concentrically surrounding the rotary control member and further having a boss cavity, raised from the control top surface of the portable electronic product; and a knob located within the fixed raised boss, the knob comprising:

a core member coupled to the rotary control member, wherein the core member axially resides within the boss cavity; and an outer over-molded portion which is integrally over-molded as one piece onto the core member;

wherein the fixed raised boss includes an outer circumference and an inner circumference, the fixed raised boss forming a knob-boss interface with the knob, where at least a portion of the core member resides within the inner circumference and within the boss cavity, and the outer over-molded portion resides within the outer circumference but outside the boss cavity, wherein the rotary knob assembly transfers an impact received at the knob to the fixed raised boss through the knob-boss interface while isolating the rotary switch.

18. The portable electronic product of claim 17, wherein the fixed raised boss causes the knob to be raised above other control knobs residing on the control surface.

19. The portable electronic product of claim 17, wherein the fixed raised boss provides a gripping zone elevated from the control top of the portable electronic product.

20. The portable electronic product of claim 17, wherein the fixed raised boss provides clearance to avoid inadvertent actuation of an adjacent control to the fixed raised boss of the plurality of controls on the product.

21. The portable electronic product of claim 17, wherein a length of the knob is independent of a height of the fixed raised boss.

22. The portable electronic product of claim 17, wherein the knob has a minimal length relative to a height of the fixed raised boss thereby reducing risk of impact damage.

23. The portable electronic product of claim 17, wherein the fixed raised boss is equal or greater in diameter to the knob.

24. A rotary knob assembly of a portable electronic device, comprising:

a fixed raised boss, having a boss cavity, raised from a control top surface of the portable electronic device, the control top surface comprising one or more controls for the portable electronic device; and a knob located within the fixed raised boss, the knob comprising:

a rotary switch stem coupled to a rotary switch therein;

a core member that axially resides within the boss cavity; and an outer over-molded portion which is integrally over-molded as one piece onto the core member;

wherein the fixed raised boss includes an outer circumference and an inner circumference, and the outer over-molded portion resides within the outer circumference but outside the boss cavity, the fixed raised boss forming a knob-boss interface with the knob, the rotary knob assembly transferring impacts received at the knob to the fixed raised boss through the boss-knob interface while isolating the rotary switch.

* * * * *